United States Patent [19]

Talbott et al.

[11] 4,176,798

[45] Dec. 4, 1979

[54] METHOD AND APPARATUS FOR INDUCTION AND DISPERSION OF PARTICLES IN AN AIRSTREAM

[75] Inventors: John W. Talbott; John M. Kirkwood, both of Moscow, Id.

[73] Assignee: Washington State University Research Foundation, Inc., Pullman, Wash.

[21] Appl. No.: 900,433

[22] Filed: Apr. 27, 1978

[51] Int. Cl.[2] ..... B02C 19/06

[52] U.S. Cl. ..... 241/39; 241/5

[58] Field of Search ..... 241/5, 18, 26, 39, 58

[56] References Cited

U.S. PATENT DOCUMENTS

| | | | |
|---|---|---|---|
| 1,917,266 | 7/1933 | Lissman | 241/39 X |
| 2,316,207 | 4/1943 | Winter | 241/39 |

*Primary Examiner*—E. F. Desmond

*Attorney, Agent, or Firm*—Wells, St. John & Roberts

[57] ABSTRACT

An apparatus for breaking up clumps of particulate material into an even dispersion entrained within an airstream. It includes an elongated vortex tube that is open to an intake of a radial blade blower. The opposite end of the vortex tube includes a coaxial choke orifice. Particulate material is fed into the vortex tube through a tangential chute at a location adjacent the one vortex tube end. In operation, a pair of coaxial helical or vortex airstreams are formed within the vortex tube, one contained within the other. The outer vortex includes a directional component directed outward from the blower intake, while the inner vortex feeds toward the blower intake and blower blades. Material fed through the chute is received tangentially within the first outer vortex and is drawn in the outward direction. As its velocity drops, it meets the interface between the two concentric vortices. At this point, a clump of material may be completely dispersed due to the shearing effect of the oppositely moving vortices and the turbulence of the air within the area at the interface. The dispersed material will work its way along the inner vortex and eventually be fed through the blower intake and subsequently forced out its discharge.

7 Claims, 2 Drawing Figures

METHOD AND APPARATUS FOR INDUCTION AND DISPERSION OF PARTICLES IN AN AIRSTREAM

BACKGROUND OF THE INVENTION

The present invention relates to methods and apparatus for dispersion of particulate material within an airstream and more particularly to such apparatus associated with a centrifugal blower.

In many felting processes involving the forming of mats of particulate materials for fiber boards, insulation materials, nonwoven fabrics, etc., it is desirable to have the fiber or particles introduced to the forming or felting stage as a uniform dispersion in an airstream. Dry particles at this stage of processing typically are in the form of numerous clumps, which produce undesirable affects when subsequently pressed. It is therefore desirable to obtain some form of apparatus and method by which fibrous or particulate material can be evenly dispersed and entrained within an airstream while being delivered to a work station.

DETAILED DESCRIPTION OF A PREFERRED EMBODIMENT

Figure 1:
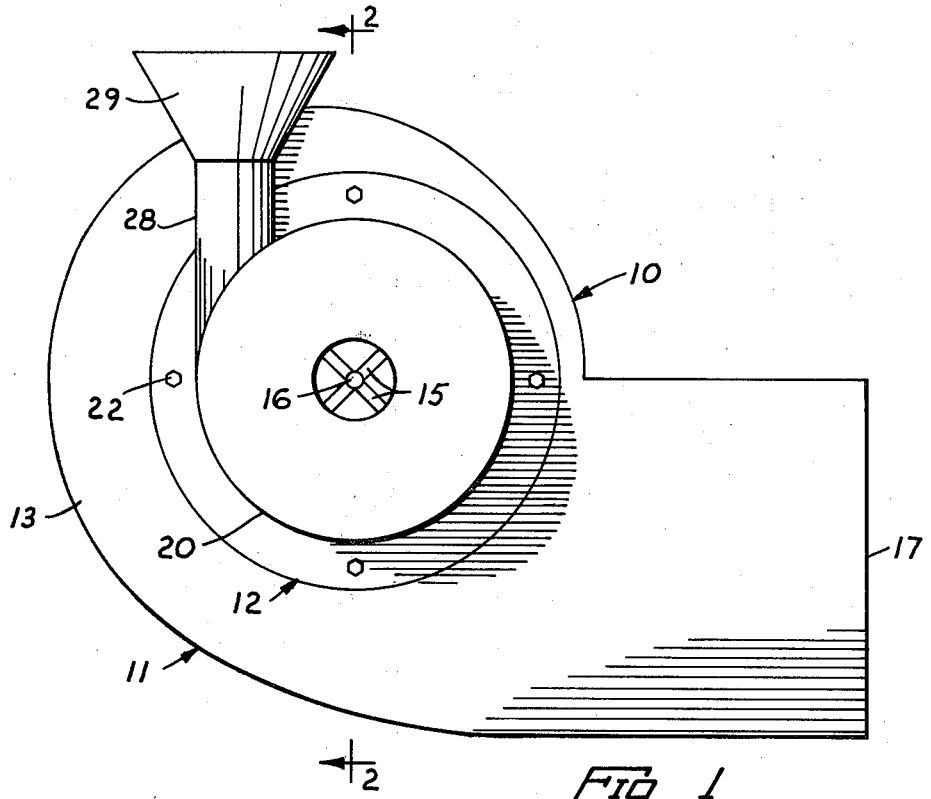
FIG. 1 is an end elevational view of the present apparatus.

The present apparatus is illustrated in the accompanying drawings and is generally designated therein by the reference character 10. The apparatus may be provided in two forms—as a complete unit including a centrifugal blower 11, or as a vortex tube assembly 12 that can be mounted to an existing blower 11.

The illustrated embodiment shows the invention applied as an attachment to a conventional radial bladed blower designed for use in a horizontal position. However, it is to be understood that the orientation of the blower is not critical to the use of the invention, and that the blower and vortex tube assembly can be in any angular orientation, including vertical orientations with the vortex tube assembly open upwardly or downwardly.

The blower includes a scroll case housing 13 having a central intake at 14. Radial blades 15 are rotatably mounted within the scroll case 13 and centered on the intake 14. The blades are designed to receive air through intake 14 and forcibly deliver it to a discharge 17. Blades 15 are connected to a central drive shaft 16 that is rotated at a selected speed by an appropriate drive mechanism and motor (not shown).

The vortex tube assembly 12 is comprised of two interconnected elements. They are an open elongated cylindrical vortex tube 20 and a particulate material infeed chute 28 leading tangentially into the tube interior.

The tube 20 includes an open end 21. This end 21 has an open interior diameter of similar dimension to the intake 14 of blower 11. A mounting means 22 is provided at the open end 21 to facilitate mounting of the tube 20 to blower 11. Assembly of the tube 20 and blower 11 may be completed prior to shipping of the apparatus 10 or may be performed by the purchaser if it is desired that assembly 12 be utilized with an existing centrifugal blower.

The tube 20 includes a hollow cylindrical bore 23 that leads from the open end 21 to a choke orifice 24 at an opposite tube end 25. Opening 21, cylindrical bore 23 and choke orifice 24 are coaxial. Further, the mounting means 22 enables the vortex tube assembly 12 to be fixed in a coaxial relationship to the blower intake 14 and drive shaft 16.

The particulate material infeed chute 28 is shown as being capped by a hopper. It opens at 30 tangentially into the cylindrical bore 23 of tube 20. The relationship of the chute to tube 20 is important. First, chute 28 is located adjacent to the open tube end 21. Its axis is shown at substantially right angles to the axis of tube 20, but the angle of entrance is not particularly critical. It is preferable that there be direct unobstructed tangential feeding of fibrous or other particulate material into the cylindrical bore 23 to facilitate entry of the material into the moving streams of air.

The infeed chute 28 is gravity fed in the illustrated embodiment, but this disclosure is not to be limited to such an application. In fact, substantial negative pressure is applied at the opening between chute 28 and tube 20, which can be used to draw fibrous material upwardly from a source of material when desired. Chute 28 can therefore be at any desired angular configuration or opening tangentially to the interior of tube 20.

The particular location of the infeed chute 28 on one side or the other of the tube 20 (FIG. 1) is, of course, determined by the directional rotation of the blades. Preferably the hopper will be located as shown in FIG. 1 when the blades 15 are to be rotated in a counterclockwise direction. It follows then that if the blades rotate in a clockwise direction, the hopper will be situated on the opposite side of the tube. In this manner, the circulation of air within the outer vortex described below will assist in drawing material downwardly within chute 28 because of the resulting lower pressure at that side of the tube.

Figure 2:
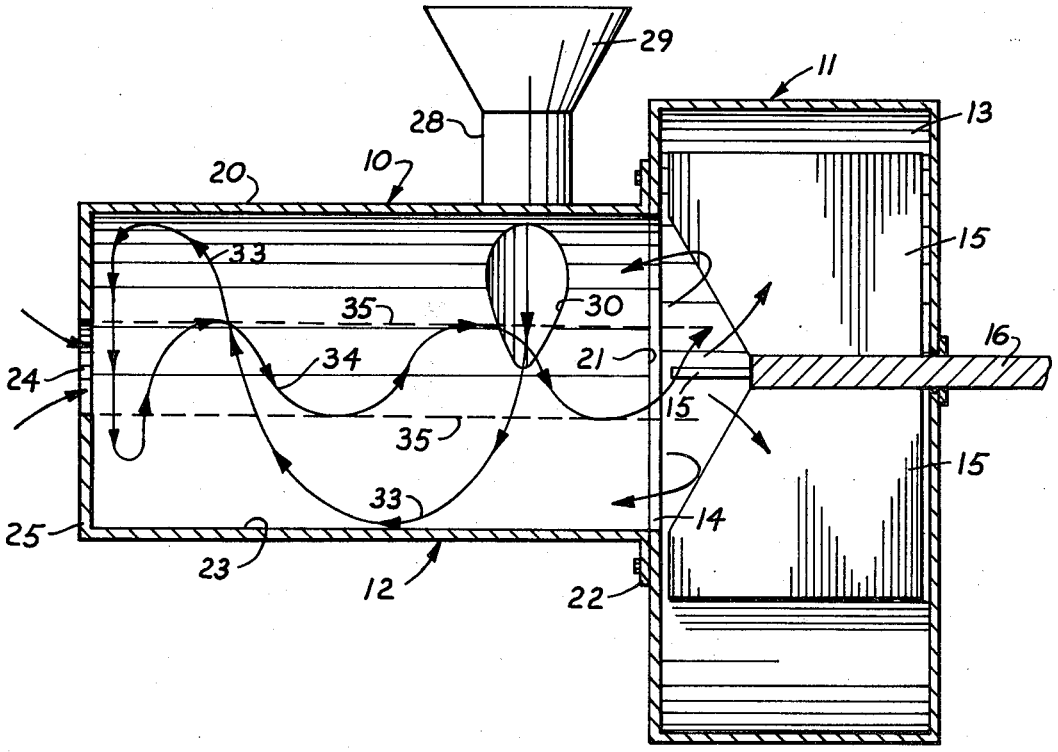
FIG. 2 is a sectional view taken along line 2—2 in FIG. 1.

It will be noted that the choke orifice 24 is substantially smaller in diameter when compared to the open end 21 of tube 20. This produces a lowering of pressure within tube 20. The combined cross-section of orifice 24 and chute 28 must be less than the area of blower intake 14, preferably substantially less. This relationship, in conjunction with the operation of blower 11, draws air through orifice 24 and chute 28 to produce two concentric vortices. An outer vortex is diagrammatically illustrated in FIG. 2 by the directional line 33. An inner vortex is indicated at 34. An interface diagrammatically illustrating the border between the inner and outer vortex is illustrated at 35.

The present method of induction and dispersion of particulate material in an airstream is accomplished in conjunction with the above-described apparatus in the following manner.

The outer vortex 33 is produced within the confines of tube 20 by air delivered through chute 28 as well as by rotational movement of the blades 15. The outer vortex includes a directional component leading away from the open end 21. This is so because of the size differential between choke orifice 24 and the open end 21 of tube 20. The volume acceptable through intake 14 of blower 11 and demanded by the rotating blades is considerably more than that allowed by the choke orifice. Therefore, only part of the actual capacity is drawn through the blower, the remainder being turned back at the blades. This forms the outer vortex with the outward horizontal directional component. The core, or inner vortex is part of the turbulent air within the tube that is drawn into the blades and is subsequently discharged. Therefore the inner vortex is seen to have an inward horizontal directional component, leading into the blades. The interface 35 between the vortices serves as an area of shear due to the oppositely moving bodies of air (vortices) that has the effect of breaking up clumps of particulate material received through the infeed hopper 28.

The opposed inner and outer helical flow patterns of air within the vortex tube results in very high shear and turbulence, especially at the innerface between the two vortices. Entrained fibers or particles enter the inner helical flow gradually through this turbulent interface—particularly near the choke orifice end of the vortex tube—and any clumps or aggregations of particles are dispersed by the high turbulence and shear. The dispersed fibers carried by the inner helical flow enter the blower inlet and are then either discharged from the blower outlet or caused to reenter the vortex tube in the outer helical flow, (outer vortex) and then recirculated along its length.

The particles have a dwell time of many seconds in the vortex tube which can thus act as a "surge bin". This action affords an effective smoothing of the time rate or fiber delivery. In other words, short term abrupt variations in particle input rate will cause only slight and gradual changes in the delivery rate through the blower discharge.

The above description has been given by way of example to describe a preferred form of the invention. The scope of the invention is defined only by the claims.

We claimed:

1. An apparatus for induction and dispersion of particulate materials in an airstream, comprising:

a centrifugal blower having a central inlet and a tangential air discharge;

a horizontally oriented cylindrical tube having one end in open communication with the blower central inlet and having a choke orifice at an opposite end of smaller dimension than the opening of the tube to said central blower inlet;

upright particulate material infeed means in open tangential communication with the tube interior;

the combined cross-sectional area of said choke orifice and particulate material infeed means being less than the area across the blower inlet.

2. The apparatus as defined by claim 1 wherein the blower includes radially oriented blades rotatable about a fixed axis centered on the central blower inlet.

3. The apparatus as defined by claim 1 wherein the choke orifice of the tube and the central inlet of the blower are coaxial.

4. The apparatus as defined by claim 1 wherein the tube is coaxial with the central inlet of the blower and wherein the choke orifice is also coaxial with the tube and central inlet.

5. The apparatus as defined by claim 1 wherein the tube is elongated and wherein the particulate material infeed hopper is located adjacent to the one tube end in open communication with the blower.

6. A vortex tube assembly mountable to the intake of a horizontal radial-bladed blower for dispersing particulate materials in an airstream, comprising:

a hollow cylindrical tube having solid cylindrical side walls extending between an open end and an opposite end partially closed to form an axially centered choke orifice of reduced size in comparison with its one open end;

means at the one open end for mounting the tube to one side of a radial-bladed blower such that the one open end covers the blower intake;

an upright particulate material infeed chute leading tangentially into the tube adjacent its one open end;

the combined cross-sectional area of the choke orifice and chute being less than the area across the blower intake.

7. The vortex tube assembly as defined by claim 6 wherein the particulate infeed chute opens tangentially into the tube and is transverse to the tube length.

* * * * *